United States Patent [19]

Itoh et al.

[11] Patent Number: 5,023,415

[45] Date of Patent: Jun. 11, 1991

[54] SWITCH APPARATUS

[75] Inventors: Syunji Itoh, Hitachi; Hiroshi Kozawa, Katsuta; Takahide Seki, Hitachi, all of Japan

[73] Assignee: Hitachi, Ltd., Tokyo, Japan

[21] Appl. No.: 441,467

[22] Filed: Nov. 27, 1989

[30] Foreign Application Priority Data

Nov. 28, 1988 [JP] Japan ..... 63-298203

[51] Int. Cl.[5] ..... H01H 33/82

[52] U.S. Cl. ..... 200/148 R; 200/148 A; 200/148 B; 200/148 F

[58] Field of Search ..... 200/148 R, 148 A, 144 B, 200/148 F, 148 G

[56] References Cited

U.S. PATENT DOCUMENTS

| | | | |
|---|---|---|---|
| 3,983,345 | 9/1976 | Phillips | 200/144 B |
| 4,445,020 | 4/1984 | Ueda et al. | 200/148 A |
| 4,675,484 | 6/1987 | Ischi et al. | 200/148 R |
| 4,677,265 | 6/1987 | Horvath | 200/148 R |

*Primary Examiner*—J. R. Scott

*Attorney, Agent, or Firm*—Antonelli, Terry, Stout & Kraus

[57] ABSTRACT

A switch apparatus for use in a distribution system, having a case, a pair of bushings arranged on the case so as to oppose each other, and a breaker arranged in the case such that breaking and closing actions take place in a direction perpendicular to an imaginary line interconnecting the pair of bushings. Both terminals of the breaker are connected to the corresponding bushings through conductors.

10 Claims, 7 Drawing Sheets

SWITCH APPARATUS

BACKGROUND OF THE INVENTION

The present invention relates to a switch apparatus and, more particularly, to a switch apparatus suitable for use as a pole switch of a distribution system.

A conventional pole switch for use in a distribution system has, as disclosed in Japanese Patent Laid-Open Publication No. 61-99226, a pair of 3-phase bushings arranged on both sides of a common horizontal axis of a container, breaking portions of three phases arranged in independent insulating molds between the pair of bushings, the breaking portion of each phase having contact terminals which make and break electrical contact by movement along the above-mentioned horizontal axis, and tulip-type contactors arranged between both contact terminals and the bushings.

Thus, the known pole switch has breaking portions which are arranged between a pair of bushings and move in the axial direction so as to make and break electrical contact, so that the length of the whole switch is inevitably large in the axial direction of the bushings. Such a long pole switch requires a strong supporting structure which is quite undesirable from the viewpoint of easy and safe mounting of the switch on a pole.

Known pole switches have been designed to be incorporated in a grounding section detection system but no consideration has been taken in regard to a short-circuit section detection system. In case of a short-circuit accident, breaking of power is achieved by a breaker in a substation, so that short-circuit current flows through a pole switch only for a short period, e.g., within 1 second. Therefore, it has been unnecessary to take any protective measure for protecting a pole switch against short-circuit current. In recent years, however, there is a demand for short-circuit section detection system including pole switches of a distribution system. Such a short-circuit section detection system can be realized by applying the technique of grounding section detection system. In such a case, short-circuit current may flow in a pole switch for a comparatively long time, e.g., 3 seconds or so. Thus, a pole switch is required to withstand an electromagnetic force generated by short-circuit current flowing in the pole switch. Unfortunately, however, existing pole switches cannot withstand electromagnetic reaction force produced by a short-circuit current.

SUMMARY OF THE INVENTION

Accordingly, an object of the present invention is to provide a switch apparatus having a reduced size.

Another object of the present invention is to provide a switch apparatus having a strength large enough to bear a reaction force produced by electromagnetic forces generated when short-circuit current flows in the switch apparatus. Still another object of the present invention is to provide a switch apparatus having a stable breaking performance over a wide range from a small current region to a large current region.

To these ends, according to one aspect of the present invention, there is provided a switch apparatus used in a distribution system, comprising: a case; a pair of bushing means arranged on the case so as to oppose each other; breaking means arranged in the case so as to extend in a direction substantially perpendicular to an imaginary line interconnecting the pair of bushing means, the breaking means having a pair of contactor means; actuator means provided in the case so as to actuate the breaking means; and a pair of conductor means connected at their one ends to corresponding ends of the breaking means, the pair of conductor means being bent so as to extend in opposite directions substantially perpendicularly to the direction of breaking action of the contactor means of the breaking means and then connected to the adjacent bushing means.

These and other objects, features and advantages of the present invention will become clear from the following description of the preferred embodiments when the same is read in conjunction with the accompanying drawings.

DESCRIPTION OF THE PREFERRED EMBODIMENTS

Figure 1:
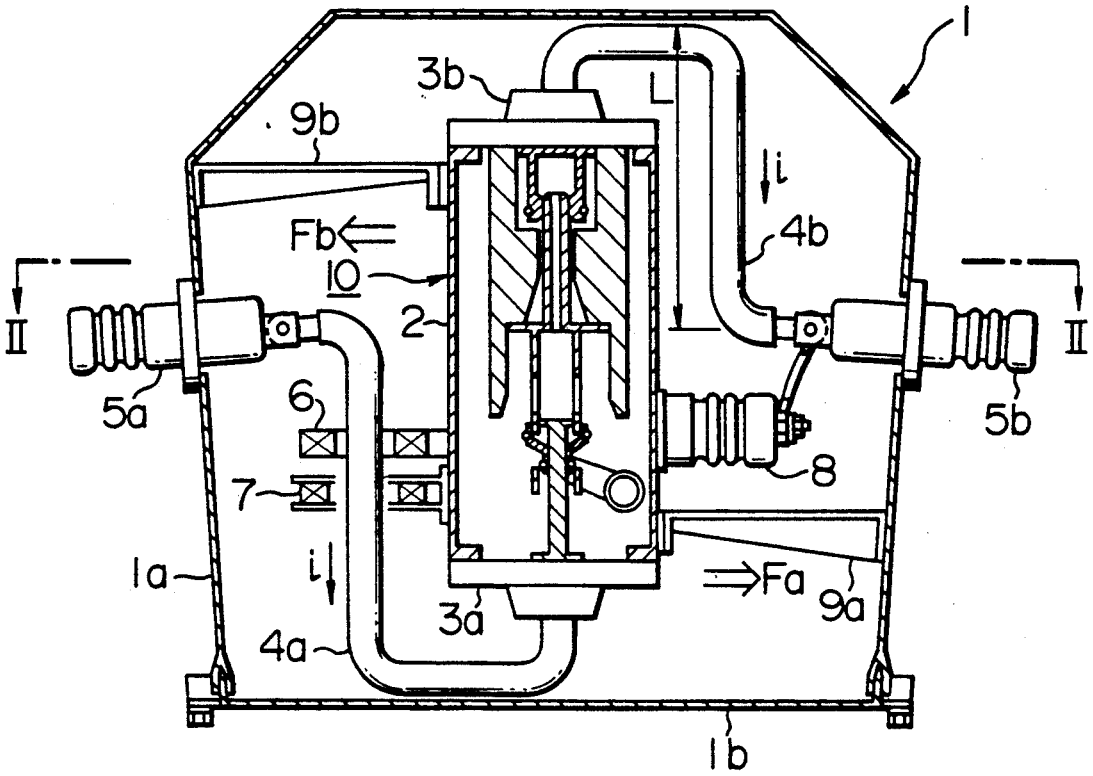
FIG. 1 is a vertical sectional view of an embodiment of the switch apparatus of the present invention.

FIG. 1 is a vertical sectional view of an embodiment of a switch apparatus of the present invention, designed to be mounted on a pole (not shown). The switch apparatus has a case 1 capable of being mounted on a pole and accommodating a breaking portion which is generally denoted by 10. The case 1 is composed of a main part 1*a* and a bottom plate 1*b* which is secured to the main part 1*a* in a water-tight manner. A pair of groups of bushings 5*a*, 5*b* are attached to the main part 1*a* of the case 1 substantially at the same level. In the illustrated embodiments, each group of bushings include three bushings each of which corresponds to one of three phases. In the following description, however, the bushings of each group will be collectively referred to as the bushing 5*a* or bushing 5*b*. Similarly, triplicate members or components of the three-phase circuits will be described in a singular form. The breaking portion 10 is arranged such that the breaking and closing are conducted by a motion in a vertical direction which is substantially orthogonal to the horizontal line interconnecting the axes of both bushings 5a, 5b, as will be described later in more detail. The breaking portion 10 has terminals which are embedded in insulating spacers 3a, 3b. These terminals are connected to one ends of insulated cables 4a, 4b. The other end of both insulated cables 4a, 4b are bent in opposite directions so as to extend in directions substantially perpendicular to the direction of the breaking motion and are then connected to corresponding bushings 5a, 5b. Therefore, the height of the case 1 can be reduced to such a degree that the top and bottom walls of the case 1 scarcely clear the insulated cables 4a, 4b. When a conductor is used in place of each insulated cable, the case 1 will have to have a greater height to provide a large insulation gap between each conductor and the adjacent wall of the case.

The breaking portion 10 is secured at its both ends on the case 1 through brackets 9a and 9b, so that the breaking portion 10 is stably held at the illustrated position with a support which is strong enough to withstand electromagnetic force which will be described later. The bracket 9a is positioned on the side of the breaking portion 10 opposite the bushing 5a which is connected to the terminal on the same end of the breaking portion 10 as the bracket 9a. The bracket 9a extends substantially in parallel with the bushing 5a so as to bear, in a compressed manner, an electromagnetic force Fa which is generated due to the arrangement of the breaking portion 10, insulated cable 4a and the bushing 5a. On the other hand, the bracket 9b is positioned on the side of the breaking portion 10 opposite to the bushing 5b which is connected the terminal on the same end of the breaking portion 10 as the bracket 9b. The bracket 9b extends substantially in parallel with the bushing 5b so as to bear, in a compressed manner, an electromagnetic force Fb which is generated due to the arrangement of the breaking portion 10, insulated cable 4b and the bushing 5b.

Current transformer 7 are disposed in a space available in the case at one side of the breaking portion 10, so as to surround respective insulated cables 4a. As will be seen also from FIG. 2, a zero-phase current transformer 6 is disposed in the above-mentioned space so as to surround the insulated cables 4a of the three phases. There is also a zero-phase potential transformer 8 having one end connected to each bushing 5b. These transformers 6 to 8 are fixed to the insulating hermetic container of the breaking portion 10. The current transformers 7 are capable of detecting any over-current which appears when, for example, a short-circuit has taken place and is used for opening the switch upon sensing such an over-current. The zero-phase current transformer 6 is capable of detecting any zero-phase current in the event of a grounding accident occurring in the load side so as to activate a grounding protection relay thereby to break the circuit. The zero-phase potential transformer 8 detects any zero-phase voltage in the event of a grounding accident and determines the direction of the grounding from the phase difference with respect to the zero-phase current by means of a directivity grounding relay, and activates the breaking portion 10 to break the circuit.

Figure 5:
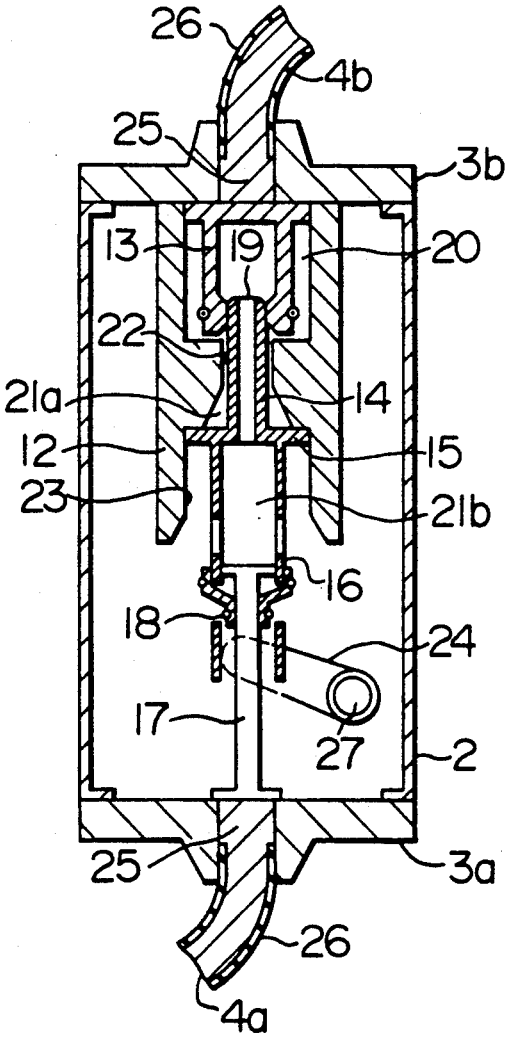
FIG. 5 is an enlarged longitudinal sectional view of a breaking portion of the switch apparatus shown in FIG. 1.
Figure 6:
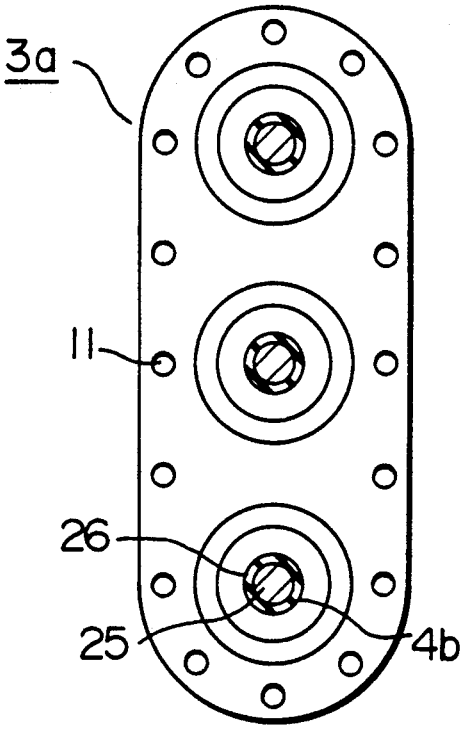
FIG. 6 is a top plan view of the breaking portion shown in FIG. 5.

As will be seen from FIG. 5, the breaking portion 10 has a common hermetic container charged with, for example, an $SF_6$ gas. The hermetic container 2 serves to protect components around this container from arcs generated in this container when the circuit is broken. Later-mentioned insulating nozzles 12 for three phases, constructed in one body, are accommodated in the container 2. Both ends of the hermetic container 2 are closed by insulating spacers 3a, 3b which is shown in plan in FIG. 6. As will be seen from FIG. 6, the insulating spacer 3a has a plurality of peripheral bolt holes 11 for fixing to the hermetic container 2 and the insulated cables 4a of the three phases are embedded in the center of this insulating spacer 3a. Each insulated cable has a central conductor 25 and an insulating cover 26 surrounding the conductor 25.

FIG. 5 shows the breaking portion 10, particularly the construction of the portion corresponding to one of the three phases. A fixed contactor 13 is connected to the central conductor 25 of the insulated cable 4b, while the center conductor 25 of the insulated cable 4a is connected to a movable contactor 14 through a blowing piston 17, collector 18 and a blowing cylinder 16. Each of the above-mentioned insulating nozzles 12 defines a self arc suppressing chamber in the region of contact between the contactors 13 and 14. The nozzle 12 has a first throat portion 22 which slidably receives the movable contact 14 so as to be closed by the movable contact 14, and a second throat portion 23 which slidably receives a suction piston 15 connected to the movable contactor 14 so as to be closed by the suction piston 15. The second throat portion 23 forms a suction cylinder which cooperates with the suction piston 15 so as to provide a suction device. This suction device has a suction chamber 21a the volume of which is increased to reduce the internal pressure in response to the breaking action of the movable contactor 14. The blowing cylinder 16 and the blowing piston 17 in cooperation provide a blowing puffer device having a blowing puffer chamber 21b. The aforementioned self arc suppressing chamber 20 is defined by the portion of the insulating nozzle 12 down to the first throat portion 22 and the movable contact 14. The self arc suppressing chamber 20 constitutes a major portion of the heat puffer device. An electrically insulated actuator lever 24 is connected to the blowing cylinder 16. The actuator lever 24 is connected to an actuator main shaft 27 shown in FIG. 2. The actuator main shaft 27 is connected at its one end to an actuator device 29, while the other end of the same is extended externally of the case 1. An indicator pointer 28 is attached to the extended end of the actuator main shaft 27 so that an operator can recognize the state of the breaking portion 10 by reading the position of the indicator pointer 28.

Figure 2:
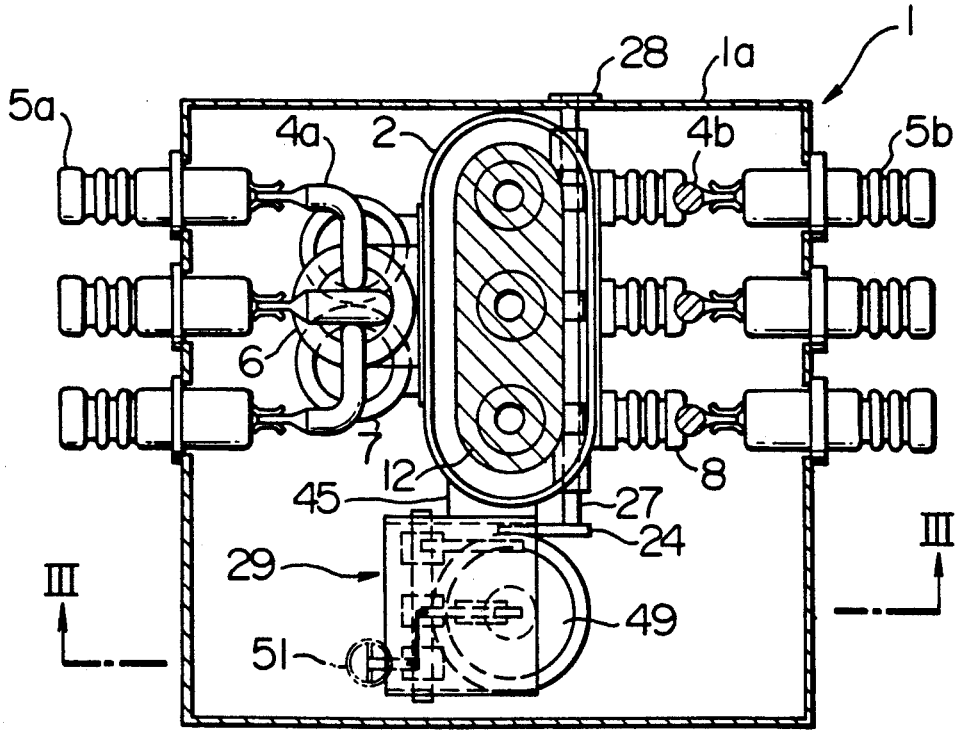
FIG. 2 is a sectional view taken along the line II—II of FIG. 1.
Figure 3:
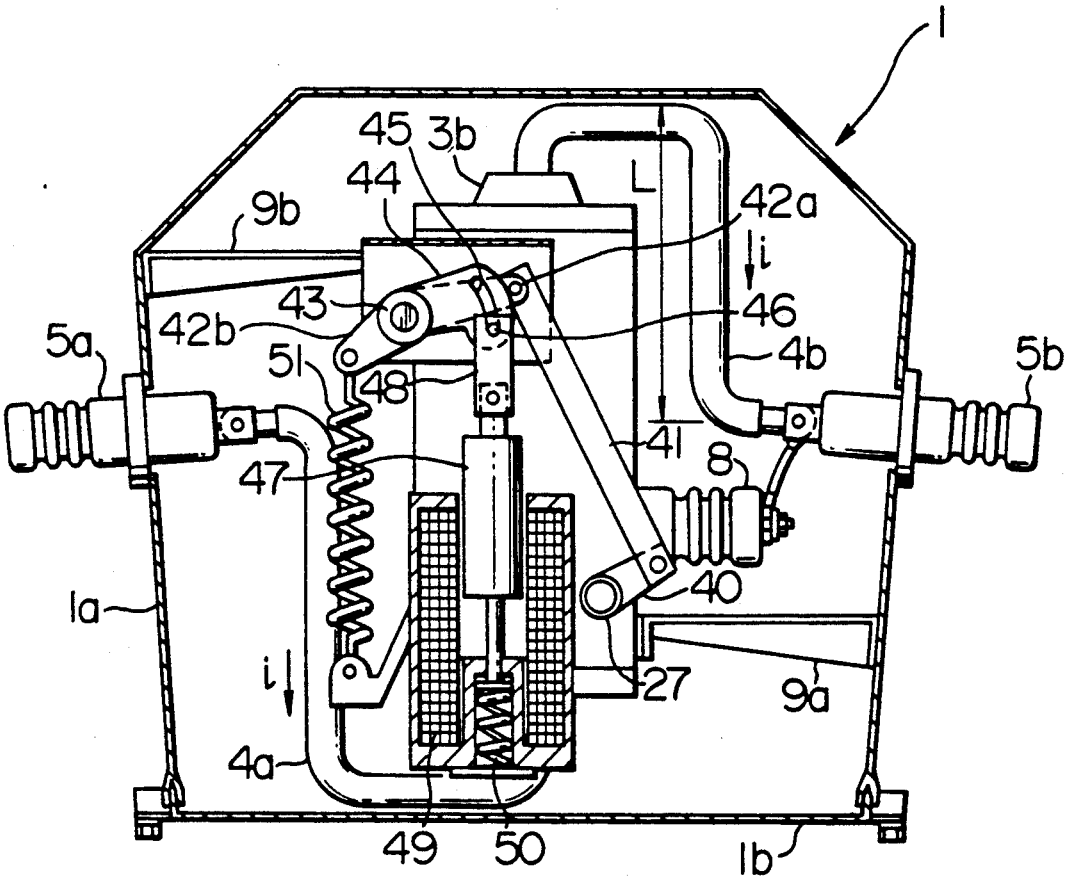
FIG. 3 is a sectional view taken along the line III—III of FIG. 2.

The construction of the aforementioned actuator device 29 will be described with reference to FIGS. 2 to 4. Referring first to FIGS. 2 and 3, the actuator main shaft 27 is connected to a lever 42a through a lever 40 and a link 41. The lever 42a is carried by a shaft 43 to which is attached a closing lever 44. An elongated hole 45 is formed in a portion of the closing lever 44 near one end thereof. The elongated hole 45 receives a pin 46 which is connected to a plunge 47 through a link 48. When an exciting coil 49 is energized, the plunger 47 is moved downward as viewed in the drawings against the force of a reset spring 50 which is shown in FIG. 3. At the same time, a spring 51 for causing the breaking operation of the breaking portion 10 is connected to the other end of the closing lever 44. When the plunger 47 is attracted by the excitation coil 49, the actuator main shaft 27 is rotated through the action of the lever 40, link 41 and the lever 42b, while the spring 51 is stretched by the closing leer 44.

Figure 4:
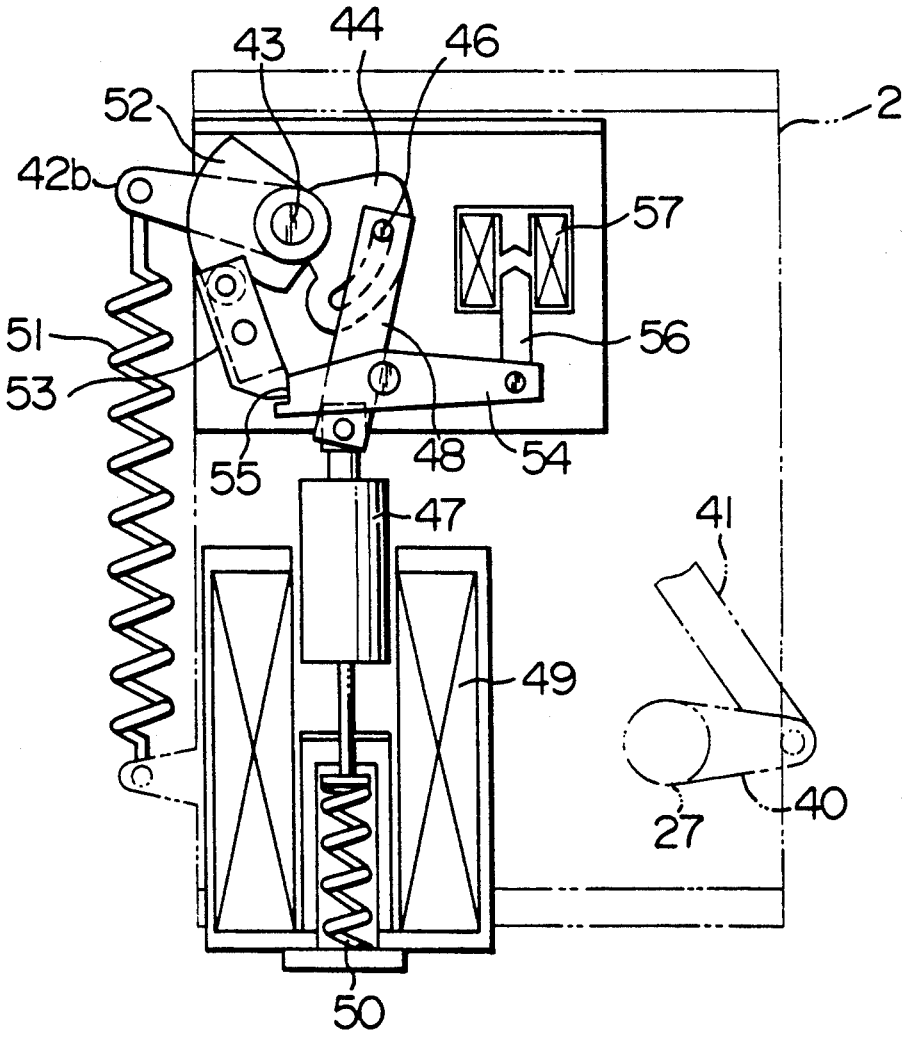
FIG. 4 is a front elevational view of a closing mechanism of an actuator incorporated in the switch apparatus of the present invention.

FIG. 4 illustrates a retaining mechanism for retaining the breaking state of the breaking portion 10 effected by the actuator device 29. This mechanism include a latch portion 55 intended for keeping the spring 51 in the stretched state. The latch portion 55 is composed of a lever hook 53 which is provided on an actuating force transmission lever 52 carried by the shaft 43 of the lever 42*b*, and a plunger hook 54. The retaining mechanism further has a plunger 56 and a trip coil 57 which serve to release the latch portion 55. The arrangement is such that, when the trip coil 57 is energized, the plunger 56 is attracted to rotate the plunger hook 54 so as to release the lever hook 53 from the latch portion 55. The tensile force accumulated in the spring 51 when closing the switch, is transmitted to the levers 41 and 52, and the lever 52 transmits the tensile force to the hook 53 so as to rotate it.

The operation of the described embodiment of the switch apparatus is as follows.

Figure 7:
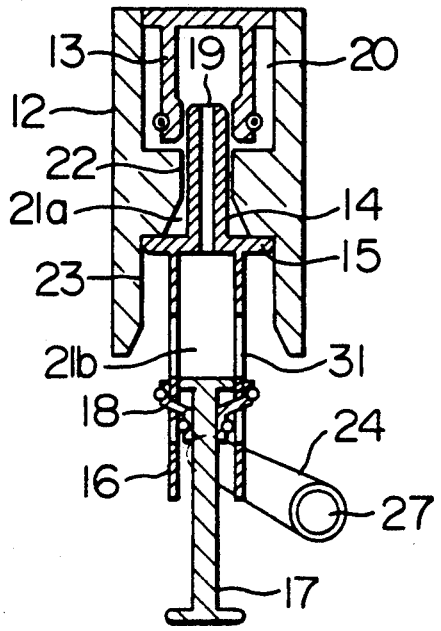
FIGS. 7 to 9 are sectional views of the breaking portion in a closing state, in a state at a beginning period of breaking operation and in a state at the end period of the breaking operation, respectively.
Figure 8:
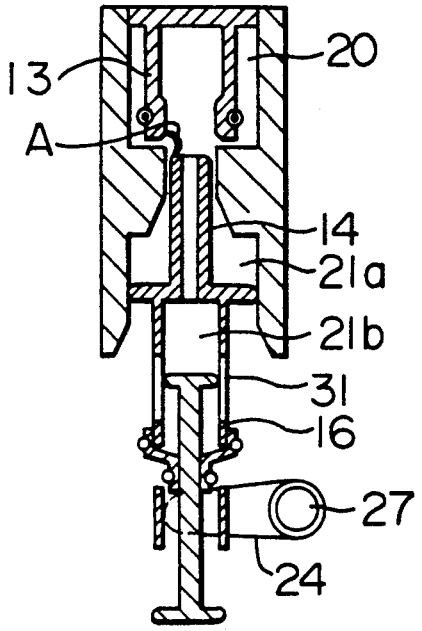
Figure 9:
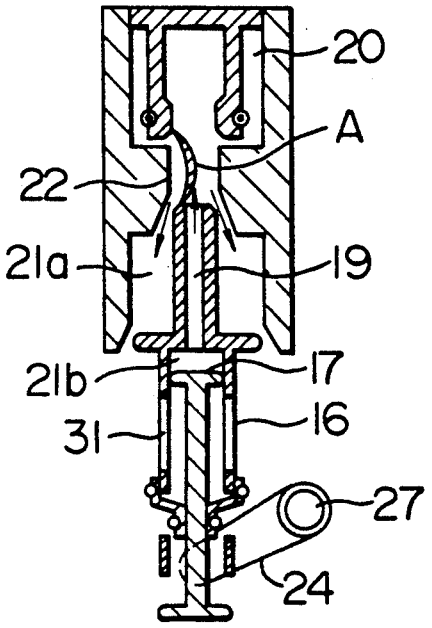

FIG. 7 shows the breaking portion 10 of the switch apparatus in a closing state. When the trip coil 57 of the actuator device 29 shown in FIG. 4 is energized, the plunger 56 is attracted so that the actuator main shaft 27 is rotated through the action of the lever 40, link 41 and the lever 42. This rotation of the actuator main shaft 27 causes the actuator lever 24 to rotate counter-clockwise as viewed in FIG. 7, so that the movable contactor 14 leaves the fixed contactor 13 as shown in FIG. 8, generating arc A therebetween. The gas pressure in the self arc suppressing chamber 20 is increased by the energy of the arc A, while the suction chamber 21*a* is expanded to generate a negative pressure therein. During this operation, the volume of the blowing puffer chamber 21*b* is decreased as a result of the downward movement of the blowing cylinder 16. However, the pressure in the blowing puffer chamber is not increased because the pressure is relieved through a slit 31 formed in the blowing cylinder 16. As the breaking operation proceeds, the movable contactor 14 leaves the first throat portion 22 as shown in FIG. 9 so that the gas in the self arc suppressing chamber 20, the pressure of which has been increased by the arc A, is relieved into the suction chamber 21*a* in which a negative pressure has been established. When the current cut-off by the breaking portion is large, the arc A has a correspondingly large energy so that the pressure in the self arc suppressing chamber 20 is raised to a sufficiently high level, so that the breaking operation is conducted safely. On the other hand, when the current cut-off by the breaking portion is small, the rise of pressure in the self arc suppressing chamber 20 is small. However, the negative pressure generated in the suction chamber 21*a* induces the gas from the self arc suppressing chamber 20, thus offering good breaking performance. Conventional switch apparatus have encountered the following problem when cutting off a medium level of current. Namely, in such a case, the pressure rise in the self arc suppressing chamber 20 is not so large, while the pressure in the suction chamber 21*a* is raised by the gas flowing into this chamber before the arc suppression is completed, so that the arc cannot be suppressed satisfactory. This problem, however, is overcome by the illustrated embodiment as will be understood from the following description.

Namely, a shown in FIG. 9, the slit 31 formed in the blowing cylinder 16 leaves the piston 17 at the end of the suction operation in which the negative pressure in the suction chamber 21*a* is reduced by the gas, so that the gas in the blowing puffer chamber 21*b* is compressed to form a flow of gas which acts on the arc A through the hollow 19 of the movable contact 14, whereby the arc is suppressed effectively. Thus, the described embodiment of the switch apparatus exhibits superior breaking performance over a wide range, from small current region to large current region.

Figure 10:
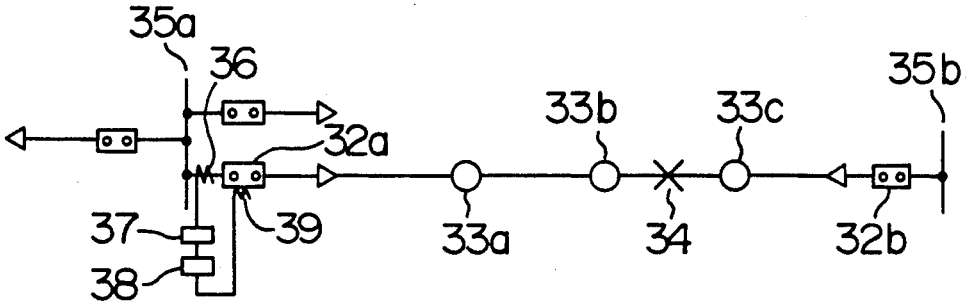
FIG. 10 is a circuit diagram of a distribution system incorporating an embodiment of the switch apparatus in accordance with the present invention.

FIG. 10 is a circuit diagram of a distribution system. A substation 35*a* has a breaker 32*a* which conducts breaking operation in response to detection of an accidental current. Namely, any accidental current is detected by the current transformer 36 which in turn gives a breaking instruction to a trip coil 39 through an accident detection relay 37 and a cooperative timer 38, thereby to break the circuit. The distribution system has a plurality of substations 35*a* or the type described and a plurality of pole switches 33*a*, 33*b*, 33*c* connected between the substation 35*a* and the substation 35*b*.

Figure 11:
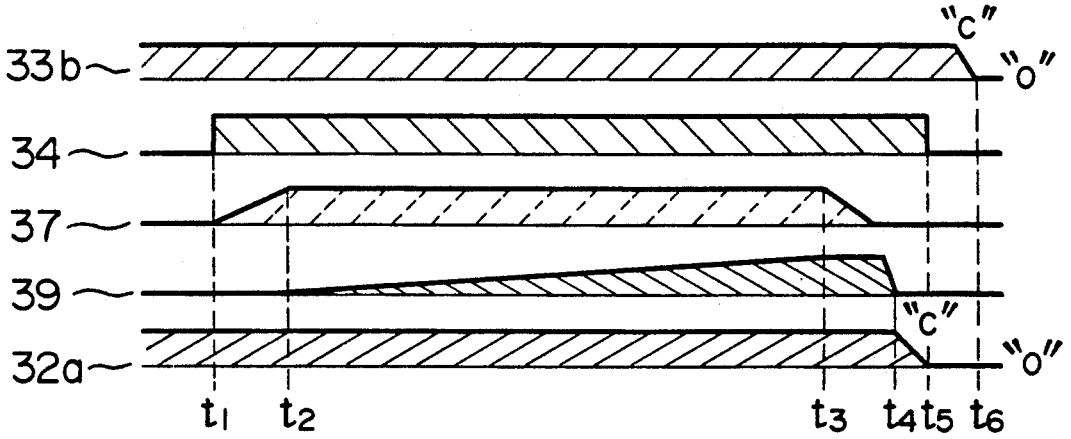
FIG. 11 is a time chart showing the operation of various components of the distribution system of FIG. 10 in a short-circuit section detection system.
Figure 12:
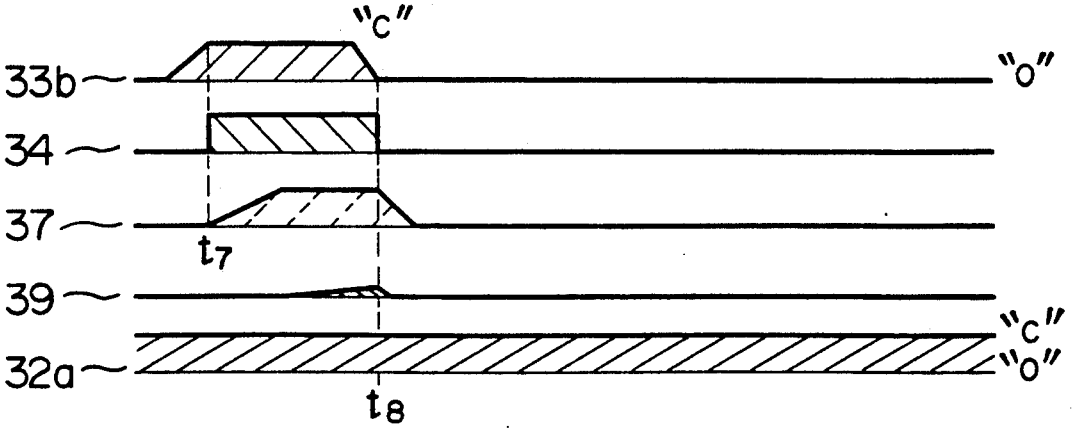
FIG. 12 is a time chart showing the operation subsequent to the operation shown in FIG. 11.

FIG. 11 is a time chart showing the operation of a grounding section detecting system.

It is assumed here that a grounding accident has taken place in the distribution system of FIG. 10 at a moment $t_1$. This accident is detected by the current transformer 36 of the breaker 32*a* in the substation 35*a*. This accident is detected by the accident detection relay 37 at a moment $t_2$ and the cooperative time 38 operates to produce a delay of about 3 seconds so that the trip coil 39 is energized at a moment $t_3$. In consequence, the breaker 32*a* commences the breaking operation at moment $t_4$, whereby the circuit is broken at a moment $t_5$. Consequently, the current by the grounding accident is cut-off and, thereafter, the switch apparatus 33*b* is operated to break the circuit at a moment $t_6$. Thus, the switch apparatus has to sustain the accidental grounding current for a period of 3 seconds or so, so that it has to be designed to withstand undesirable effect of an electromagnetic force which is generated by such a large accident current. The switch apparatus of the present invention, having the construction explained in connection with FIG. 1, is capable of withstanding such an influence of the electromagnetic force, as will be understood from the following description.

Referring to FIG. 1, the vertical length of the insulated cable 4*b* is represented by L, while the magnetic field produced by the short-circuit current i is represented by BE.

In consequence, the electromagnetic force F is given as follows:

$$F = BE \cdot i \cdot L \quad (1)$$

More specifically, the electromagnetic force F appears in both horizontal directions as indicated by arrows Fa and Fb. The electromagnetic forces Fa and Fb, however, are easily borne by the brackets 9*a*, 9*b* which are arranged to bear such forces by being compressed.

After the completion of the breaking operation, the breaker 32*a*, the switch apparatus 33*a* and the switch apparatus 33*b* are closed in the mentioned order. If the accident still exists, an accidental current 34 is detected by the current transformer 36 again at the moment $t_7$ after the closing of the switch apparatus 33*b*, so that the accident detection relay 37 operates again. In this case, a breaking instruction is given to the switch apparatus 33*b* without delay in accordance with the controller of the distribution system and the short-circuit current is cut-off at a moment $t_8$. The switch apparatus 33*b* exhibits superior breaking performance by the action of the breaking portion 10 explained before in connection with FIG. 7.

As will be understood from the foregoing description, the switch apparatus shown in FIG. 1 exhibits a strength large enough to withstand any electromagnetic force produced by a short-circuit current which is maintained for 3 seconds or so, and possesses an ability to cut-off the short-circuit current.

Figure 13:
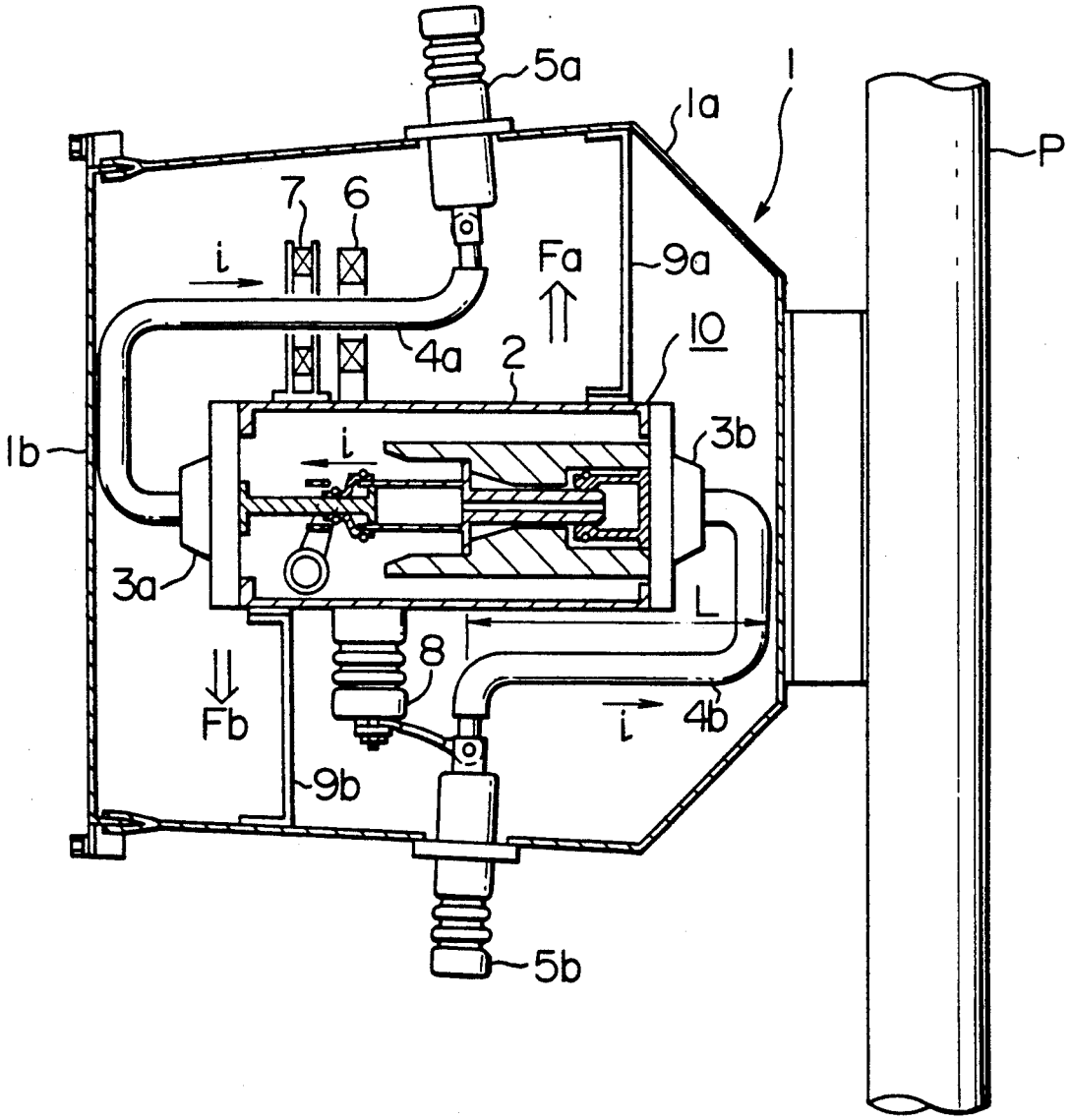
FIG. 13 is a longitudinal front elevational view of another embodiment of the switch apparatus of the present invention.

FIG. 13 is a vertical sectional view of another embodiment of the switch apparatus of the present invention. In this Figure, the same reference numerals are used to denote the same parts or members as those shown in FIG. 1. In this Figure, a symbol P represents a pole. In this embodiment, the breaking and closing action in the breaking portion 10 takes place in the horizontal directions, while the pair of bushings are led substantially vertically. Thus, the directions of the electromagnetic forces Fa and Fb generated by the short-circuit current i coincide with the direction of the force of gravity. In this case, therefore, the construction of the brackets 9*a* and 9*b* can be simplified as compared with those in FIG. 1. These brackets 9*a* and 9*b* are fixed to the hermetic container 2 of the breaking portion 10 made of an insulating material. This, however, is only illustrative and the brackets 9*a*, 9*b* may be fixed to other portions of the breaking portion provided that such portions are electrically insulated.

In the embodiments described hereinbefore, the current transformers 6, 7 are fixed to the container 2 of the breaking portion 10. Obviously, however, these transformers 6,7 may be fixed to portions of the bushings inside the case 1.

As has been described, the switch apparatus of the present invention has a breaking portion in which the breaking and closing actions take place in directions substantially perpendicular to the directions of lead-in of bushings. It is therefore possible to reduce the size of the switch apparatus, thus making it possible to mount the switch apparatus on a pole with a simplified mounting structure. In addition, the breaking portion is supported at both axial ends by means of fixed brackets such that electromagnetic forces produced by accidental current are borne by these brackets. Thus, the present invention provides a switch apparatus which has a reduced size in the directions in which the bushings are led-in and which has a construction strong enough to sustain any influence of accidental electromagnetic force.

In addition, the switch apparatus of the present invention has a blowing puffing device which compresses the blowing gas at the end of the period of operation of the suction device, so that stable breaking performance can be obtained over a wide range of cut-off currents from small current region to large current region.

What is claimed is:

1. A switch apparatus used in a distribution system, comprising:

a case;

at least one pair of bushing means arranged on said case so as to oppose each other;

breaking means arranged in said case so as to extend in a direction substantially perpendicular to an imaginary line interconnecting said pair of bushing means, said breaking means having at least one pair of contactor means;

actuator means provided in said case so as to actuate said breaking means;

first conductor means connected between first terminal means leading from one of said pair of contactor means and one of said bushing means; and second conductor means connected between second terminal means leading from the other of said pair of contactor means and the other of said bushing means;

wherein said breaking means is arranged vertically in said case such that the axis representing the direction of breaking and closing actions substantially perpendicularly crosses said imaginary line interconnecting said pair of bushings, said breaking means is encased in a hermetic container charged with an insulating gas, and said first and second conductor means being insulated cables.

2. A switch apparatus according to claim 1, wherein said breaking means include breakers corresponding to three phases of electric current.

3. A switch apparatus according to claim 2, wherein said breaking means includes, for each of said three phases, a pair of said contactors capable of making and breaking contact therebetween, a heat puffer device having a self arc suppressing chamber the pressure in which is raised by an arc generated when said contactors are separated from each other, and a suction device having a suction chamber which is expanded to generate a negative pressure therein in response to the separation of said contactors.

4. A switch apparatus according to claim 3, further comprising a blowing puffer device capable of blowing gas against said arc at the end of the period of sucking operation of said suction device.

5. A switch apparatus used in a distribution system, comprising:

a case;

at least one pair of bushing means arranged on said case so as to oppose each other;

breaking means arranged in said case so as to extend in a direction substantially perpendicular to an imaginary line interconnecting said pair of bushing means, said breaking means having at least one pair of contactor means;

actuator means provided in said case so as to actuate said breaking means;

first conductor means connected between first terminal means leading from one of said pair of contactor means and one of said bushing means;

second conductor means connected between second terminal means leading from the other of said pair of contactor means and the other of said bushing means, and supporting means for supporting said breaking means at its sides opposite to the direction in which said first and second conductor means are led;

wherein said breaking means is arranged vertically in said case such that the axis representing the direction of breaking and closing actions substantially perpendicularly crosses said imaginary line interconnecting said pair of bushings, said breaking means is encased in a hermetic container charged with an insulating gas, and said first and second conductor means are insulated cables.

6. A switch apparatus according to claim 5, wherein said breaking means include breakers corresponding to three phases of electric current.

7. A switch apparatus according to claim 6, wherein said breaking means includes, for each of said three phases, a pair of said contactors capable of making and breaking contact therebetween, a heat puffer device having a self arc suppressing chamber the pressure in which is raised by an arc generated when said contactors are separated from each other, and a suction device having a suction chamber which is expanded to generate a negative pressure therein in response to the separation of said contactors.

8. A switch apparatus according to claim 6, further comprising a blowing puffer device capable of blowing gas against said arc at the end of the period of sucking operation of said suction device.

9. A switch apparatus according to claim 8, further comprising current measurement current transformers disposed in said case.

10. A switch apparatus according to claim 8, further comprising current measurement voltage transformers disposed in said case.

* * * * *